US009915912B2

(12) United States Patent
Mori et al.

(10) Patent No.: US 9,915,912 B2
(45) Date of Patent: Mar. 13, 2018

(54) DISCHARGING LIGHT QUANTITY ADJUSTING DEVICE AND IMAGE FORMING APPARATUS

(71) Applicant: FUJI XEROX CO., LTD., Tokyo (JP)

(72) Inventors: Mitsuhiro Mori, Ebina (JP); Masato Katsukawa, Ebina (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/260,019

(22) Filed: Sep. 8, 2016

(65) Prior Publication Data

US 2017/0277063 A1 Sep. 28, 2017

(30) Foreign Application Priority Data

Mar. 24, 2016 (JP) ..... 2016-059309

(51) Int. Cl.

| | |
|---|---|
| ***G03G 21/00*** | (2006.01) |
| ***G03G 21/08*** | (2006.01) |
| ***G03G 15/047*** | (2006.01) |
| ***G03G 15/045*** | (2006.01) |
| ***G03G 13/045*** | (2006.01) |
| ***G03G 15/00*** | (2006.01) |

(52) U.S. Cl.

CPC ..... *G03G 21/08* (2013.01); *G03G 13/045* (2013.01); *G03G 15/045* (2013.01); *G03G 15/047* (2013.01); *G03G 15/5037* (2013.01)

(58) Field of Classification Search

CPC ... G03G 15/045; G03G 15/047; G03G 13/045

See application file for complete search history.

(56) References Cited

FOREIGN PATENT DOCUMENTS

| | | | | |
|---|---|---|---|---|
| JP | 57161872 A | * | 10/1982 | ..... G03G 15/047 |
| JP | H05-289458 A | | 11/1993 | |
| JP | 2008-191554 A | | 8/2008 | |
| JP | 2008-310311 A | | 12/2008 | |

* cited by examiner

*Primary Examiner* — Ryan Walsh
(74) *Attorney, Agent, or Firm* — Oliff PLC

(57) ABSTRACT

A discharging light quantity adjusting device includes a potential measurement controller that performs: a process of causing a first toner image forming process to charge an image holding member to a first potential and an electrometer to measure an electrostatic potential on the image holding member to obtain a first value, a process of causing a second toner image forming process to charge the image holding member to a second potential and removing a toner image formed by the second toner image forming process, and a process of causing a third toner image forming process to charge the image holding member to a third potential, and causing the electrometer to measure an electrostatic potential on the image holding member to obtain a second value; and a light quantity adjusting unit that adjusts a quantity of a discharging light based on the first and second values.

11 Claims, 8 Drawing Sheets

DISCHARGING LIGHT QUANTITY ADJUSTING DEVICE AND IMAGE FORMING APPARATUS

CROSS-REFERENCE TO RELATED APPLICATIONS

This application is based on and claims priority under 35 USC 119 from Japanese Patent Application No. 2016-059309 filed Mar. 24, 2016.

BACKGROUND

1. Technical Field

The present invention relates to an discharging light quantity adjusting device and an image forming apparatus.

2. Related Art

In some cases, an image including a residual image of a previously formed image may be formed due to a light exposure history of an image holding member.

SUMMARY

According to an aspect of the invention, there is provided an discharging light quantity adjusting device for adjusting a discharging light quantity to be irradiated by an discharging unit in an image forming section that performs a toner image forming process by charging, exposure, and development to an image holding member, the image forming section including: the image holding member on which a toner image is formed while the image holding member rotates and which holds the formed toner image; a charging unit that electrically charges the image holding member; an exposure unit that exposes the image holding member to light so as to form a latent image by a potential distribution on the image holding member; a developing unit that develops the latent image formed on the image holding member by toner so as to form a toner image on the image holding member; a transfer unit that transfers the toner image formed on the image holding member onto a transfer object; the discharging unit that irradiates discharging light onto the image holding member so as to electrically discharge the image holding member; a cleaner that cleans toner remaining on the image holding member after transfer; and an electrometer that measures an electrostatic potential on the image holding member, wherein the discharging light quantity adjusting device including:

a potential measurement controller that performs:

a first process of causing the image forming section to perform a first toner image forming process to electrically charge the image holding member to a first target potential, and causing the electrometer to measure an electrostatic potential on the image holding member so as to obtain a first measured value, a second process of causing the image forming section to perform a second toner image forming process to electrically charge the image holding member to a second target potential different from the first target potential and removing, from the image holding member, a toner image formed on the image holding member by the second toner image forming process, and a third process of causing the image forming section to perform a third toner image forming process to electrically charge the image holding member to a third target potential and causing the electrometer to measure an electrostatic potential on the image holding member so as to obtain a second measured value; and a light quantity adjusting unit that adjusts a quantity of the discharging light to be irradiated by the discharging unit based on the first and second measured values.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the present invention will be described.

Figure 1:
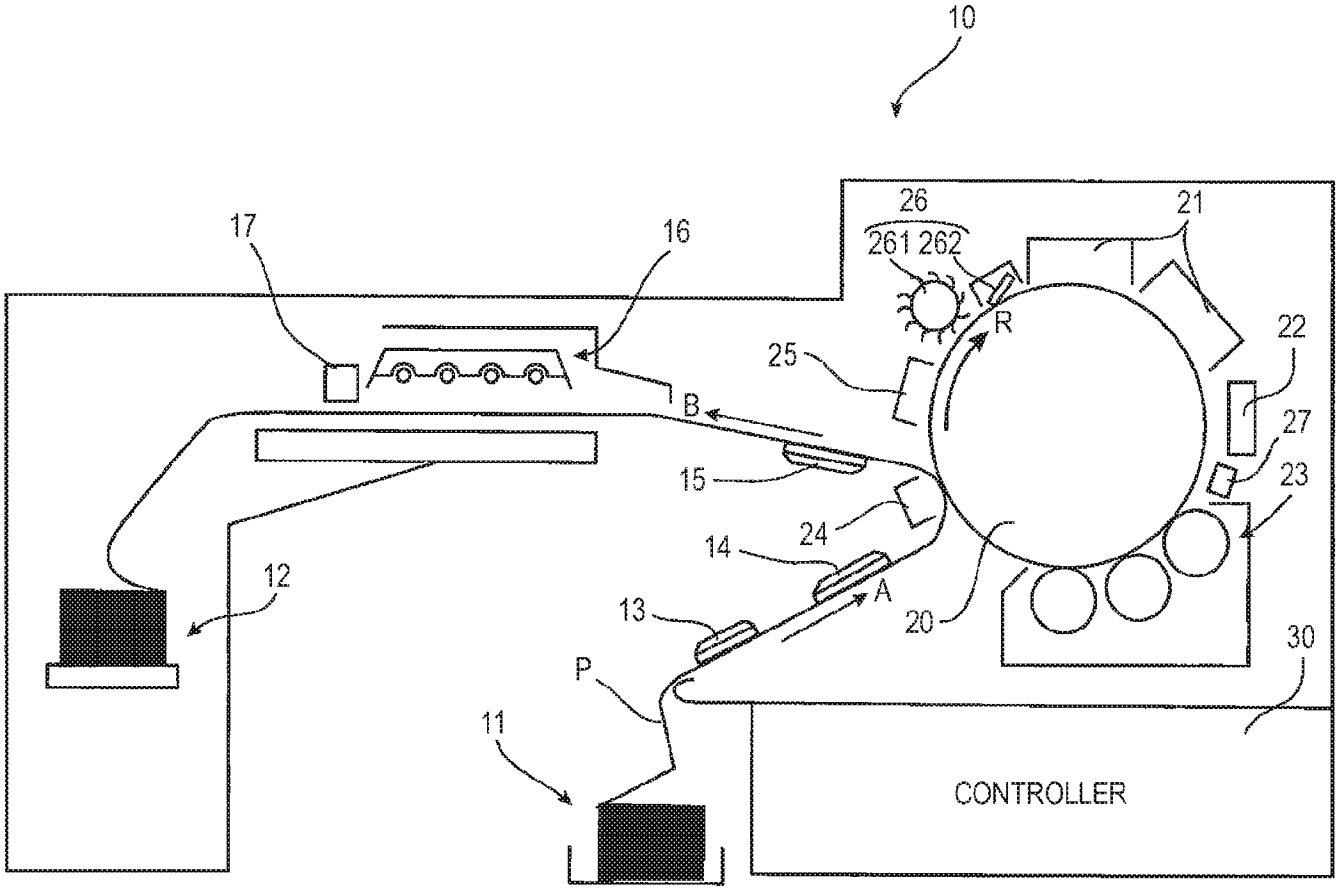
FIG. 1 is a view illustrating a schematic configuration of a book sheeting printer as an exemplary embodiment of an image forming apparatus of the present invention.

FIG. 1 is a view illustrating a schematic configuration of a book sheeting printer as an exemplary embodiment of an image forming apparatus of the present invention. This book sheeting printer is provided with a discharging light quantity adjusting device as an exemplary embodiment of the present invention.

A paper hopper 11 accommodates a paper P in a folded state. The paper P accommodated in the paper hopper 11 is transported in the direction of the arrow A by a front tractor 13 and an upstream tractor 14 via a transfer position facing a photoreceptor 20, and further transported in the direction of the arrow B by a downstream tractor 15 so that the paper P is accommodated in a folded state on a paper stacker 12 via a flash fixing device 16.

The photoreceptor 20 has a drum shape and rotates in the direction of the arrow R. A charging unit 21, an exposure unit 22, and a developing unit 23 are arranged around the photoreceptor 20, and a toner image is formed on the photoreceptor 20 by charging, exposing, and developing processes. The toner image formed on the photoreceptor 20 is transferred onto the paper P by a transfer unit 24.

After the transfer, the photoreceptor 20 is electrically discharged by a discharging unit 25, and cleaned by a cleaner 26 including a cleaning brush 261 and a cleaning blade 262.

The toner image transferred onto the paper P advances into a flash fixing device 16 along with the transport of the paper P, and is irradiated by flash light from the flash fixing device 16 so as to be fixed on the paper P. Scattering toner or fine paper powders generated during the flash light emission by the flash fixing device 16 are sucked by a suction unit 17. Thereafter, the paper P is accommodated on the paper stacker 12.

The book sheeting printer 10 includes a controller 30, and the above-described operations are performed under a control by the controller 30.

Further, the book sheeting printer 10 includes an electrometer 27 that measures a surface potential of the photoreceptor 20. Potential data obtained through the measurement by the electrometer 27 is input to the controller 30. Based on the received potential data, the controller 30 calculates a light quantity of discharging light to be irradiated from the discharging unit 25 to the photoreceptor 20, and controls the discharging unit 25 to irradiate the calculated light quantity of discharging light to the photoreceptor 20. Details will be described later.

Here, prior to describing the exemplary embodiment, a residual image and a cause for the occurrence of the residual image will be described.

Figure 2:
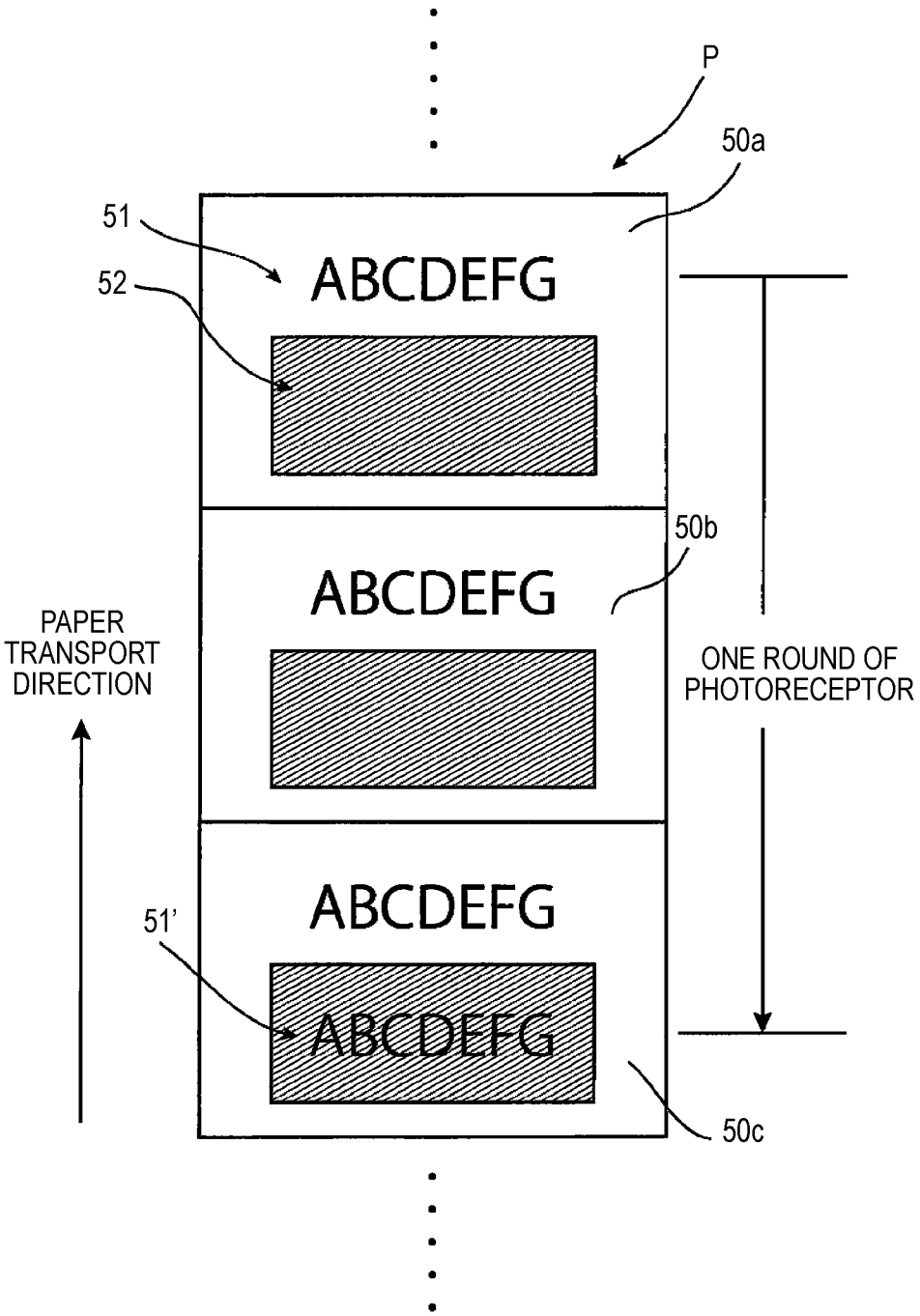
FIG. 2 is a view illustrating a state in which images having the same composition are repeatedly formed on paper.

FIG. 2 is a view illustrating a state in which images 50*a*, 50*b*, 50*c*, . . . having the same composition are repeatedly formed on a paper.

In each of the images 50*a*, 50*b*, 50*c*, . . . , "ABCDEFG" characters 52 and a halftone FIG. 52 are drawn. Here, it is supposed that the characters 51 of the image 50*a* are drawn at a location on the photoreceptor 20, and the halftone FIG. 52 of the separate image 50*c* is drawn on the same location after one rotation of the photoreceptor 50. When this circumstance occurs, it may cause a phenomenon that a residual image 51' of the characters 51 drawn prior to the one round of the photoreceptor 20 appears to overlap with the halftone FIG. 52.

Figure 3:
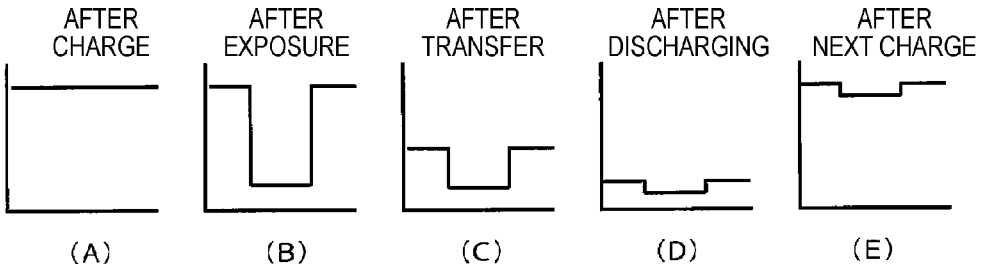
FIG. 3 is views for explaining a cause of occurrence of a residual image.

FIG. 3 is views for explaining a cause of occurrence of a residual image.

While rotating, the photoreceptor 20 repeats a cycle that includes electric charge by the charging unit 21, exposure by the exposure unit 22, development by the developing unit 23, transfer of a toner image formed by the development onto paper P through the transfer unit 24, and discharging by the discharging unit 25.

(A) of FIG. 3 is a view schematically illustrating a surface potential distribution of a charged photoreceptor. Here, the surface of the photoreceptor is uniformly charged.

(B) of FIG. 3 is a view schematically illustrating a surface potential distribution of the photoreceptor after light exposure. The potential of the exposed portion drops, and an electrostatic latent image is formed.

(C) and (D) of FIG. 3 are views schematically illustrating the surface potential distribution of the photoreceptor after transfer and discharging, respectively. When a discharging light quantity is deficient even after the transfer and the discharging, a residual image of the electrostatic latent image may remain as represented in (D) of FIG. 3.

(E) of FIG. 3 is a view schematically illustrating the surface potential distribution of the photoreceptor charged in a next cycle. The photoreceptor is electrically charged while the residual image remaining after the discharging in the previous cycle is taken over. When a halftone image of which a residual image is easily actualized overlaps with the portion where the residual image is taken over, the residual image appears on an image formed on paper P as illustrated in FIG. 2.

Figure 4:
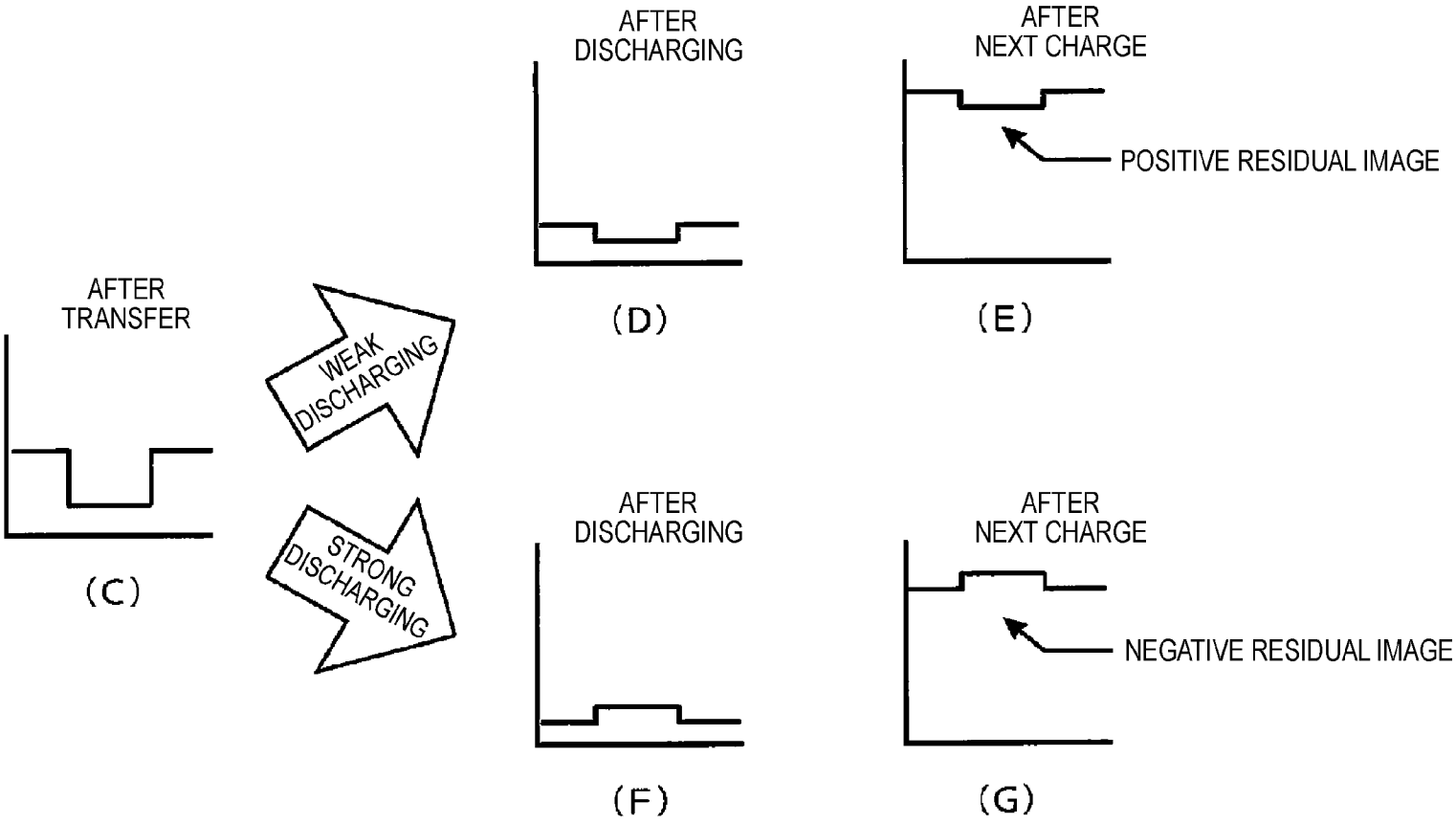
FIG. 4 is views illustrating a relationship between surplus and deficit of a discharging light quantity and a residual image.

FIG. 4 is views illustrating a relationship between surplus and deficit of a discharging light quantity and a residual image.

Like (C) of FIG. 3, (C) of FIG. 4 illustrates the surface potential distribution of the photoreceptor after transfer.

When the discharging light quantity is deficient, as described above with reference to FIG. 3, the residual image of the electrostatic latent image (so-called positive residual image) remains even after the discharging without completely erasing the electrostatic latent image after the transfer ((D) of FIG. 4), and the positive residual image is taken over even in the next electric charge ((E) of FIG. 4).

Meanwhile, when the discharging light quantity is excessive, as illustrated in (F) of FIG. 4, a residual image in which the potential distribution is reversed (so-called negative residual image) occurs after the discharging, and is also taken over in the next electric charge. This negative residual image may also be actualized on an image to be formed on the paper P.

Although the toner image formed on the photoreceptor 20 is transferred onto the paper P by the operation of the transfer unit 24, the toner forming the toner image partially remain on the photoreceptor 20 rather than being thoroughly (100%) transferred. In this case, when an excessive quantity of discharging light is irradiated, the location on the photoreceptor 20 where the toner of the toner image did not exist prior to the transfer is electrically discharged strongly, but in the location where the toner existed, the discharging light is partially blocked by the remaining toners after the transfer, and the location is not electrically discharged to the same extent as that of the location where the toners did not exist. In this case, the negative residual image may occur as illustrated in (F) of FIG. 4, and the image of the location that is not electrically discharged may become a void.

That is, a residual image may occur in both the case where the discharging light is too strong and the case where the discharging light is too weak. Thus, it is required to irradiate an appropriate quantity of discharging light which is neither overly strong nor overly weak.

Figure 5:
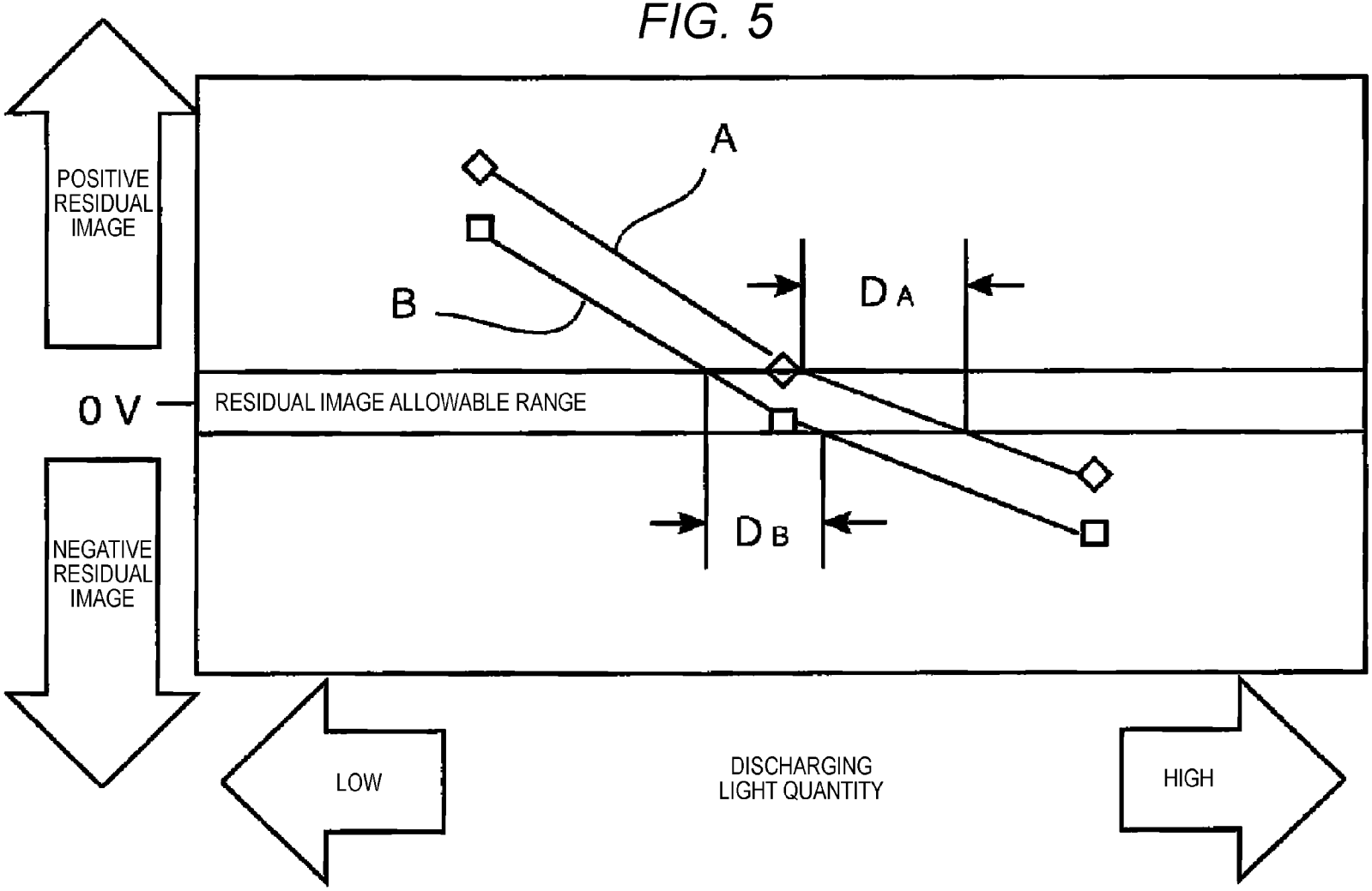
FIG. 5 is a view illustrating a relationship between a discharging light quantity (horizontal axis) and a residual image (vertical axis)

FIG. 5 is a view illustrating a relationship between a discharging light quantity (horizontal axis) and a residual image (vertical axis). The two curves A and B represent a variation in residual image intensity in two different photoreceptors A and B, respectively, depending on a discharging light quantity. A residual image allowable range in which a residual image hardly appears on paper P is set near the residual image intensity 0V. Therefore, the residual image on the photoreceptor may be made to fall within the residual image allowable range by adjusting the discharging light quantity for the photoreceptor A to fall within the discharging light quantity range DA, and adjusting the discharging light quantity for the photoreceptor B to fall within the discharging light quantity range DB.

Figure 6:
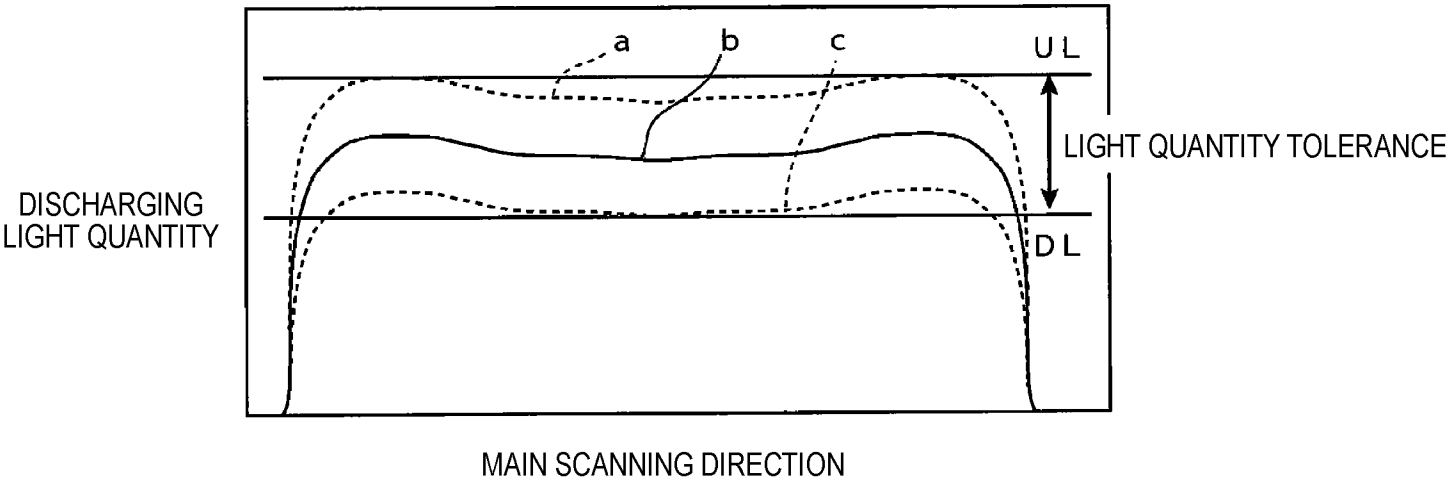
FIG. 6 is a view illustrating a variation in light quantity of light emission of a discharging unit.

FIG. 6 is a view illustrating a light quantity variation in light emission of the discharging unit.

In FIG. 6, the horizontal axis represents the position of the discharging unit in the main scanning direction (the direction orthogonal to the paper surface of FIG. 1 and the width direction of the paper P). In FIG. 6, the vertical axis represents a light quantity of the discharging light generated from the discharging unit 25. The book sheeting printer of the exemplary embodiment uses a discharging unit 25 controlled or selected to provide a discharging light quantity which ranges from a lower limit value DL to an upper limit value UL when the discharging unit is caused to emit light under a predetermined light emission condition. This means that there is not only a discharging unit that emits light in a discharging light quantity having a median of a light quantity tolerance between the upper and lower limit values UL and DL, like the curve b, but also a discharging unit that emits light in a discharging light quantity close to the upper limit value UL, like the curve a, or the lower limit value DL, like the curve c. The difference in the light emission performance of the discharging unit also affects the occurrence of a residual image.

Figure 7:
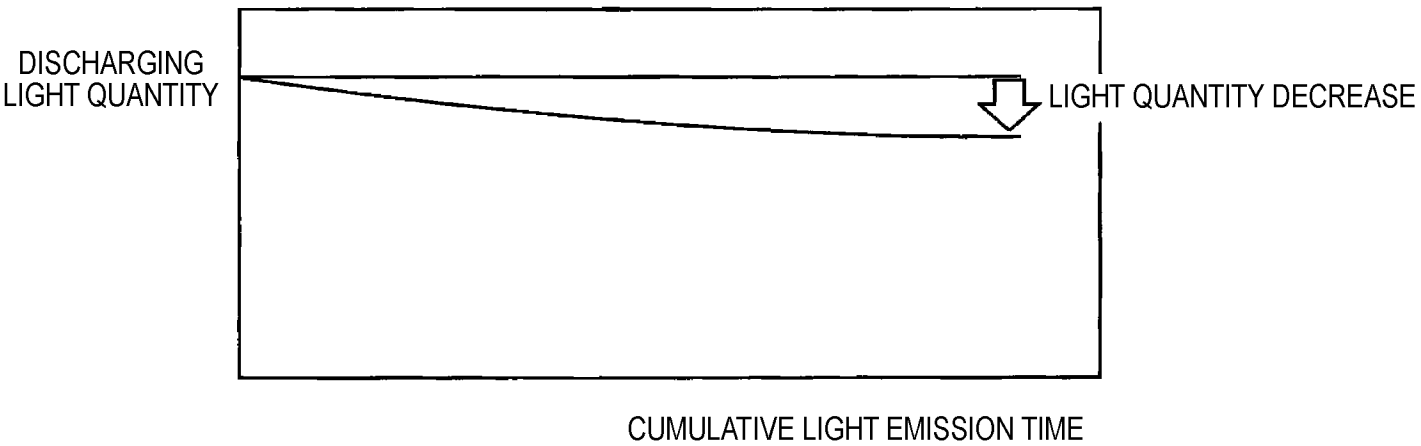
FIG. 7 is a view illustrating a variation in discharging light quantity in relation to cumulative light emission time of the discharging unit (horizontal axis)

FIG. 7 is a view illustrating a variation in discharging light quantity depending on cumulative light emission time of the discharging unit (horizontal axis).

As illustrated in FIG. 7, when the discharging unit is used for a long time, the discharging light quantity decreases with the lapse of time under the same light emission condition. The change of the discharging unit according to the lapse of time also affects the occurrence of a residual image.

A discharging light quantity adjusting mode in the exemplary embodiment will be described based on the above descriptions of the residual image phenomenon and the cause of occurrence of the residual image phenomenon.

Figure 8:
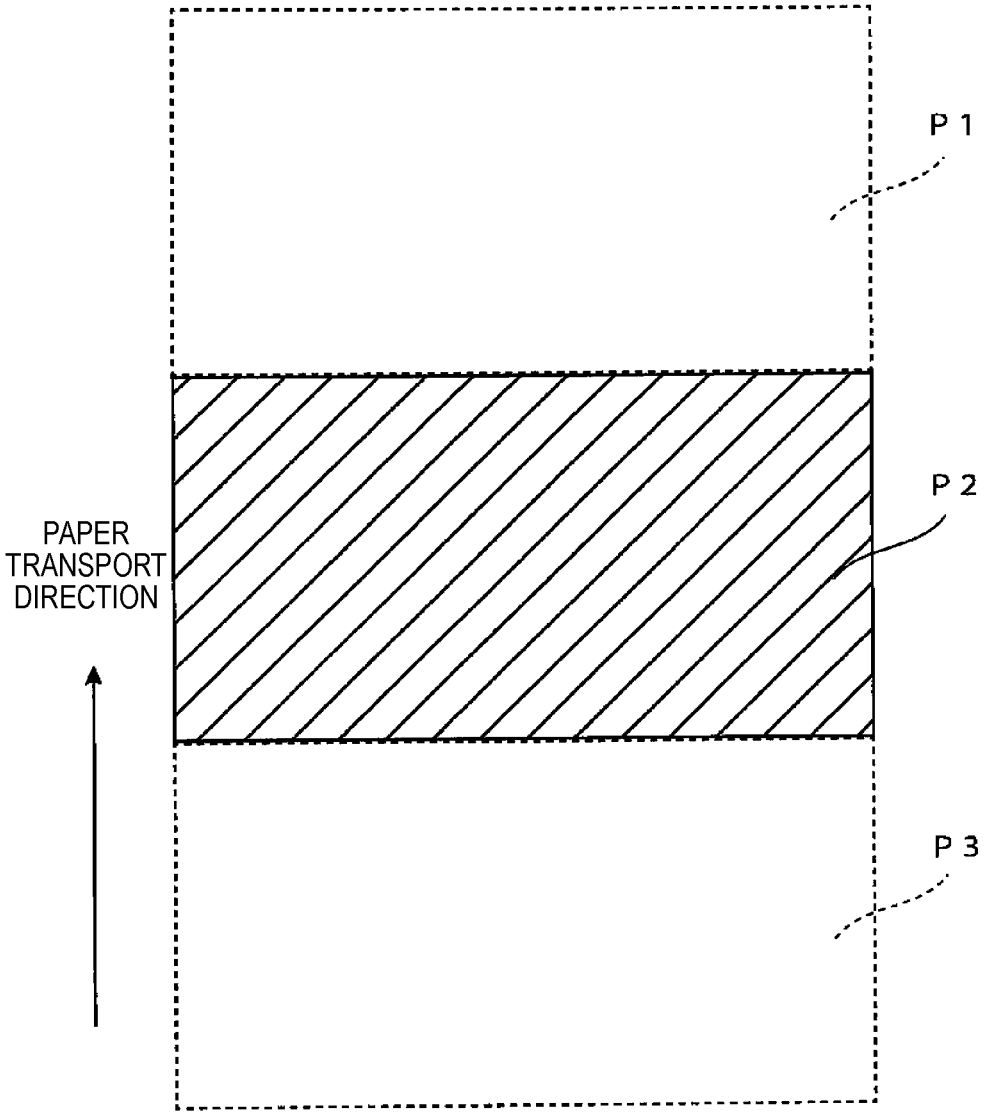
FIG. 8 is a schematic view of an electrostatic latent image formed on a photoreceptor in a discharging light quantity adjusting mode.

FIG. 8 is a schematic view of an electrostatic latent image formed on the photoreceptor in the discharging light quantity adjusting mode.

This discharging light quantity adjusting mode is executed, for example, when a power is supplied to the book sheeting printer 10 or at a timing designated by an operator.

In the discharging light quantity adjusting mode, the surface potential of the photoreceptor 20 is measured, and the discharging light quantity to be irradiated to the photoreceptor 20 is adjusted by the discharging unit 25 according to the measured surface potential, under the control of the controller 30 illustrated in FIG. 1. The measurement of the surface potential of the photoreceptor 20 in the discharging light quantity adjusting mode includes first to third processes to be described below.

In the measurement of the surface potential of the photoreceptor 20, the first process performs a first toner image forming process that electrically charges the photoreceptor 20 with a first target potential and causes the electrometer 27 to measure an electrostatic potential on the photoreceptor 20 so as to obtain a first measured value. Specifically, in the exemplary embodiment, in the first process, an electrostatic latent image P1 having a 0% halftone dot density as a first target potential is formed on the photoreceptor 20 over the length corresponding to the one round of the photoreceptor 20. Since the electrostatic latent image P1 has the 0% halftone dot density, the image is not developed by the developing unit 23, and in other words, become a toner image in blank form.

In the first process, the potential of the 0% halftone dot density is measured by the electrometer 27. This means that the potential after charge as illustrated in (A) of FIG. 3 is measured. In the exemplary embodiment, the potential of the electrostatic latent image P1 is measured over the one round of the photoreceptor 20, and an average potential for the one round is calculated. In the exemplary embodiment, the potential calculated as described above corresponds to an example of a first measured value mentioned in the present invention.

In addition, the second process is a process of performing a second toner image forming process that charges the photoreceptor 20 with a second target potential different from the first target potential, and remove, from the photoreceptor 20, the toner image formed on the photoreceptor 20 by the second toner image forming process. Specifically, in the exemplary embodiment, an electrostatic latent image P2 having a 100% halftone dot density as the second target potential is formed on the photoreceptor 20. The electrostatic latent image P2 having the 100% halftone dot density is also formed over the length corresponding to the one round of the photoreceptor 20, like the electrostatic latent image P1 of the 0% halftone dot density. In addition, as illustrated in FIG. 8, the width of the electrostatic latent image P2 in the longitudinal direction of the photoreceptor 20 may be formed throughout the entire region in the longitudinal direction, but may be a predetermined width which includes the measurement range of the electrometer 27 in the position where the electrometer 27 is disposed, in the longitudinal direction of the photoreceptor 20. In this case, the toner image to be removed is reduced.

The electrostatic latent image P2 having the 100% halftone dot density is developed by the developing unit 23, thereby forming a toner image of which the entire face is full of toner. This toner image is transferred onto the paper P, and the remaining toner is removed by the cleaner 26.

In addition, the third process is a process of performing a third toner image forming process that charges the photoreceptor 20 to a third target potential and causes the electrometer 27 to measure the electrostatic potential on the photoreceptor 20 so as to obtain a second measured value. Specifically, in the exemplary embodiment, in the third process, an electrostatic latent image P3 having a 0% halftone dot density as the third target potential is formed over the length corresponding to the one round of the photoreceptor 20, as in the above-described first process. In the third process, the potential of the electrostatic latent image P3 having the 0% halftone dot density is measured by the electrometer 27 over the one round of the photoreceptor 20, and an average potential thereof is calculated.

The potential obtained by the third process corresponds to the potential dropped due to a residual image as illustrated in (E) of FIG. 3 and (E) of FIG. 4 or the potential rising due to a residual image as illustrated in (G) of FIG. 4. In the exemplary embodiment, the potential obtained in the third process corresponds to an example of the second measured value mentioned in the present invention.

In the discharging light quantity adjusting mode, a differential potential between the potential obtained in the first process and the potential obtained in the third process is calculated. Then, the discharging light quantity is adjusted in the direction of the plus or minus sign of the differential potential by a quantity corresponding to an absolute value of the differential potential.

In this case, the characteristics of the photoreceptor 20 or the discharging unit 25 that is actually used in the book sheeting printer 10 may be measured in advance, or the usage history of, for example, the photoreceptor 20 or the discharging unit 25 may be inspected so that the discharging light quantity may be adjusted to be within the residual image allowable range or to the residual image intensity 0V (see FIG. 5) by performing the first to third processes only once. Alternatively, without considering the detailed characteristics, the discharging light quantity may be gradually adjusted by repeatedly performing the first to third processes.

According to the exemplary embodiment, the discharging light quantity may be adjusted to be within the residual image allowable range, in spite of the change of the characteristic of the photoreceptor 20 (see FIG. 5), the change of the characteristic of the discharging unit 25 (see FIG. 6), and the change of the characteristic of the discharging unit 25 according to time lapse (see FIG. 7).

In addition, in the exemplary embodiment, while descriptions have been made assuming that each of the first and third target potentials is a potential of an electrostatic latent image having the 0% halftone dot density, each of the first and third target potentials is not required to be a potential of an electrostatic latent image having the 0% halftone dot density. However, a current residual image level can be calculated with higher accuracy in a case where the potential difference of the first and third target potentials from the second target potential is larger. Therefore, it is desirable that each of the first and third target potentials is the potential of the 0% halftone dot density.

In addition, in the exemplary embodiment, while descriptions have been made assuming that the second target potential is a potential of an electrostatic latent image having the 100% halftone dot density, the second target potential is not required to be a potential of an electrostatic latent image having the 100% halftone dot density. However, a current residual image level can be calculated with higher accuracy in a case where the potential difference of the second target potential from the first target potential and the third target potential is larger. Therefore, it is desirable that the second target potential is the potential of the 100% halftone dot density.

In addition, the first and third target potentials are not required to be the same, and even when the first and third target potentials are different from each other, the current residual image level may be calculated after potential measurement. However, the calculation may be facilitated when the first and third target potentials are set in advance. Further, in order to maximize the potential differences between the first and second target potentials and between the second and third target potentials, as described above, both the first and third target potentials are required to be equal to the potential of the 0% halftone dot density.

In addition, in the exemplary embodiment, all the electrostatic latent image P1 of the 0% halftone dot density in the first process, the electrostatic latent image of the 100% halftone dot density in the second process, and the electrostatic latent image of the 0% halftone dot density in the third process are formed to have the length corresponding to the one round of the photoreceptor 20. In the measurement of the average potential over the one round of the photoreceptor 20, it is sufficient if each of the electrostatic latent images P1, P2, and P3 has a length corresponding to the one round of the photoreceptor 20. Formation of a longer electrostatic latent image may cause waste of time or toner.

In addition, even in a case where each of the electrostatic latent images P1, P2, and P3 is shorter than the length corresponding to the rotation cycle of the photoreceptor 20, it is possible to adjust the discharging light quantity by performing a potential measurement for the location when the respective electrostatic latent images P1, P2, and P3 are formed at the same location on the photoreceptor 20. However, when the measurement result for the one round of the photoreceptor 20 is adopted, the discharging light quantity may be favorably adjusted over the entire circumference of the photoreceptor 20.

In addition, in the exemplary embodiment, the book sheeting printer 10 illustrated in FIG. 1 is described as an exemplary embodiment of the present invention, but the present invention may be widely applied to a monochrome or color image forming apparatus which forms an image on a so-called cut paper as well as the book sheeting printer.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A discharging light quantity adjusting device for adjusting a discharging light quantity to be irradiated by a discharging unit in an image forming section that performs a toner image forming process by charging, exposure and development to an image holding member, the image forming section comprising: the image holding member on which a toner image is formed while the image holding member rotates and which holds the formed toner image; a charging unit that electrically charges the image holding member; an exposure unit that exposes the image holding member to light so as to form a latent image by a potential distribution on the image holding member; a developing unit that develops the latent image formed on the image holding member by toner so as to form a toner image on the image holding member; a transfer unit that transfers the toner image formed on the image holding member onto a transfer object; the discharging unit that irradiates discharging light onto the image holding member so as to electrically discharge the image holding member; a cleaner that cleans toner remaining on the image holding member after the transferring; and an electrometer that measures an electrostatic potential on the image holding member, wherein the discharging light quantity adjusting device comprises:

a potential measurement controller that performs:

a first process of causing the image forming section to perform a first toner image forming process to electrically charge the image holding member to a first target potential, and causing the electrometer to measure an electrostatic potential on the image holding member so as to obtain a first measured value, a second process of causing the image forming section to perform a second toner image forming process to electrically charge the image holding member to a second target potential different from the first target potential and removing, from the image holding member, a toner image formed on the image holding member by the second toner image forming process, and a third process of causing the image forming section to perform a third toner image forming process to electrically charge the image holding member to a third target potential and causing the electrometer to measure an electrostatic potential on the image holding member so as to obtain a second measured value; and a light quantity adjusting unit that adjusts a quantity of the discharging light to be irradiated by the discharging unit based on the first and second measured values.

2. The discharging light quantity adjusting device according to claim 1, wherein the first target potential in the first process and the third target potential in the third process are equal to each other.

3. The discharging light quantity adjusting device according to claim 2, wherein each of the first toner image forming process in the first process and the third toner image forming process in the third process is a toner image forming process of forming a toner image of a 0% halftone dot density in which no toner is attached onto the image holding member.

4. The discharging light quantity adjusting device according to claim 3, wherein the second toner image forming process in the second process is a toner image forming process of forming a toner image of a 100% halftone dot density which is full of toner.

5. The discharging light quantity adjusting device according to claim 4, wherein each of the first toner image forming process in the first process, the second toner image forming process in the second process and the third toner image forming process in the third process is a toner image forming process of forming a toner image over one round of the image holding member.

6. The discharging light quantity adjusting device according to claim 3, wherein each of the first toner image forming process in the first process, the second toner image forming process in the second process and the third toner image forming process in the third process is a toner image forming process of forming a toner image over one round of the image holding member.

7. The discharging light quantity adjusting device according to claim 2, wherein the second toner image forming process in the second process is a toner image forming process of forming a toner image of a 100% halftone dot density which is full of toner.

8. The discharging light quantity adjusting device according to claim 7, wherein each of the first toner image forming process in the first process, the second toner image forming process in the second process and the third toner image forming process in the third process is a toner image forming process of forming a toner image over one round of the image holding member.

9. The discharging light quantity adjusting device according to claim 2, wherein each of the first toner image forming process in the first process, the second toner image forming process in the second process and the third toner image forming process in the third process is a toner image forming process of forming a toner image over one round of the image holding member.

10. The discharging light quantity adjusting device according to claim 1, wherein each of the first toner image forming process in the first process, the second toner image forming process in the second process and the third toner image forming process in the third process is a toner image forming process of forming a toner image over one round of the image holding member.

11. An image forming apparatus comprising:

an image forming section that comprises: an image holding member on which a toner image is formed while the image holding member rotates and which holds the formed toner image; a charging unit that charges the image holding member; an exposure unit that exposes the image holding member to light so as to form a latent image by a potential distribution on the image holding member; a developing unit that develops the latent image formed on the image holding member by toner so as to form a toner image on the image holding member; a transfer unit that transfers the toner image formed on the image holding member onto a transfer object; a discharging unit that irradiates discharging light onto the image holding member so as to electrically discharge the image holding member; a cleaner that cleans toner remaining on the image holding member after the transferring; and an electrometer that measures an electrostatic potential on the image holding member, and performs a toner image forming process by charging, exposure and development to the image holding member;

a fixing device that fixes the toner image provided on a paper which is the transfer object or onto which the toner image is further transferred from the transfer object, onto the paper;

a potential measurement controller that performs a first process of causing the image forming section to perform a first toner image forming process to electrically charge the image holding member to a first target potential and causing the electrometer to measure an electrostatic potential on the image holding member so as to obtain a first measured value, a second process of causing the image forming section to perform a second toner image forming process to electrically charge the image holding member to a second target potential different from the first target potential and removing, from the image holding member, a toner image formed on the image holding member by the second toner image forming process, and a third process of causing the image forming section to perform a third toner image forming process to electrically charge the image holding member to a third target potential and causing the electrometer to measure an electrostatic potential on the image holding member so as to obtain a second measured value; and a light quantity adjusting unit that adjusts a quantity of the discharging light to be irradiated by the discharging unit based on the first and second measured values.

* * * * *